US009142924B2

(12) United States Patent
Tarulli

(10) Patent No.: US 9,142,924 B2
(45) Date of Patent: Sep. 22, 2015

(54) SURFACE MOUNT COAXIAL CABLE CONNECTOR

(71) Applicant: Zierick Manufacturing Corporation, Mount Kisco, NY (US)

(72) Inventor: Raffaele Tarulli, Irvington, NY (US)

(73) Assignee: ZIERICK MANUFACTURING CORP., Mount Kisco, NY (US)

( * ) Notice: Subject to any disclaimer, the term of this patent is extended or adjusted under 35 U.S.C. 154(b) by 0 days.

(21) Appl. No.: 13/954,273

(22) Filed: Jul. 30, 2013

(65) Prior Publication Data

US 2014/0057464 A1 Feb. 27, 2014

Related U.S. Application Data

(60) Provisional application No. 61/692,434, filed on Aug. 23, 2012.

(51) Int. Cl.

| | |
|---|---|
| ***H01R 24/50*** | (2011.01) |
| ***H01R 43/26*** | (2006.01) |
| ***H01R 4/24*** | (2006.01) |
| ***H01R 9/053*** | (2006.01) |
| ***H01R 43/01*** | (2006.01) |
| ***H01R 103/00*** | (2006.01) |

(52) U.S. Cl.

CPC ..... *H01R 24/50* (2013.01); *H01R 9/053* (2013.01); *H01R 43/26* (2013.01); *H01R 4/2491* (2013.01); *H01R 43/01* (2013.01); *H01R 2103/00* (2013.01); *Y10T 29/49147* (2015.01)

(58) Field of Classification Search

CPC ... H01R 4/2491; H01R 9/053; H01R 2103/00
USPC ..... 439/63, 394, 578, 395, 456
See application file for complete search history.

(56) References Cited

U.S. PATENT DOCUMENTS

| | | | | |
|---|---|---|---|---|
| 4,261,632 | A | 4/1981 | Narozny | |
| 6,120,314 | A * | 9/2000 | Harting et al. | 439/394 |
| 6,960,097 | B2 | 11/2005 | Morishita | |
| 6,992,544 | B2 | 1/2006 | Barnes et al. | |
| 7,320,616 | B1 * | 1/2008 | Legrady et al. | 439/404 |
| 7,837,494 | B2 | 11/2010 | Vich | |
| 8,628,353 | B2 * | 1/2014 | Yokoyama | 439/582 |
| 2008/0176439 | A1 * | 7/2008 | Chen et al. | 439/345 |

* cited by examiner

*Primary Examiner* — Tho D Ta
*Assistant Examiner* — Justin Kratt
(74) *Attorney, Agent, or Firm* — Myron Greenspan Lackenbach Siegel LLP

(57) ABSTRACT

A surface mount coaxial cable connector comprising a generally elongate block. A channel extends between the proximate and remote ends for receiving a coaxial cable and includes an upstream larger diameter channel and a downstream, smaller diameter channel for receiving with little clearance the central conductor after the shield and the outer layer have been removed. The lower surface of the block is provided with slots extending from the lower surface to the stepped channel. One slot is arranged along said central plane and aligned with the central conductor within the smaller diameter channel and two slots are offset from the central plane. A plurality of piercing blade contacts within the slot extend beyond said lower surface that have extended piercing contact portions with opposing free edges suitable for surface mounting on a printed circuit board.

17 Claims, 4 Drawing Sheets

SURFACE MOUNT COAXIAL CABLE CONNECTOR

CROSS REFERENCE TO RELATED APPLICATION

This application is related to Provisional Patent application Ser. No. 61/692,434 filed on Aug. 23, 2012.

BACKGROUND OF THE INVENTION

1. Field of the Invention

The invention generally relates to surface mount connectors and, more specifically, to a coaxial cable surface mount connector.

2. Description of the Prior Art

Coaxial connectors are well known and have been used to terminate coaxial cables in numerous applications. Typically, such connectors are mounted on a housing or at the edge of a printed circuit board. However, a simple and inexpensive coaxial cable connector suitable for surface mounting, for example, by a pick-and-place machine has not been available.

U.S. Pat. No. 4,261,632 to Narozny discloses a "Coaxial Cable Connector". However, this connector is in a form of a termination for a coaxial cable that can be used as a plug or part of a union for connecting a cable to a piece of electrical equipment or to another cable having a counterpart or mating connector. An external contact 14 appears to pierce the outside insulation layer and make contact with the outer electrical conducting sheath while the external connector 12 pierces the inner layer of insulation between the central conductor and the sheath for making contact with this central conductor 16. However, as indicated, this is more in the nature of a terminal connector at the end of a coaxial cable that is intended to be connected to electrical equipment or with another mating connector, as noted. The contacts are spaced from each other and are not housed within an integral pressure block that can pierce both connectors after they have been attached to a printed circuit board by application of a single force on a block.

U.S. Pat. No. 6,120,314 similarly discloses a plug connector for connecting conductor tracks to at least one coaxial cable. After coaxial cables are inserted into an insertion duct, the partial removal of the screen at which point the contacts are pressed into the slot-type clearances. The relevant conductors are cut into thereby connecting to the plug contacts. The conductor contacts or blades are axially spaced from each other and individually actuatable. In addition to being individually actuatable, the contacts are provided with spring clips intended to exert a pressure to insure reliable contact. However, clearly, the clips are not designed nor intended to be surface mounted. In fact, as a result of projections that project in the same direction as the clips, it would be impossible to solder the clips to a PCB board for surface mounting. The clip 9 is arranged along the axis of the cable and the clips 10 are offset one to each side of the axis.

U.S. Pat. No. 6,960,097 to Morishita is for a "Pressure Connection Structure with Coaxial Cable". The patent discloses a pressure connection for coaxial cables using piecing terminals suitable for connection with outer coaxial cables and a connector using pressure connection structures.

A "Shielded Surface Mount Coaxial Connector" is disclosed in U.S. Pat. No. 6,992,544 to Barnes et al. However, this patent discloses a coaxial connector that can be SMT mounted or connected to a printed circuit board. However, it does not teach an insulation piercing connector suitable for surface mounting of a coaxial cable but connection of a coax connector to a PCB.

U.S. Pat. No. 7,320,616 discloses a plurality of piercing elements attached to a single pressure block. However, the IDC connector assembly is for connection to multiple individual wires as shown and not to a coaxial cable.

SUMMARY OF THE INVENTION

Accordingly, it is an object of the present invention to provide a surface mountable coaxial cable assembly.

It is another object of the present invention to provide a coaxial cable assembly that is simple in construction and economical to manufacture.

It still another object of the present invention to provide a coaxial cable assembly that can be easily and efficiently surface mounted by a pick-and-place machine.

It is yet another object of the present invention to provide a coaxial cable assembly as in the previous objects designed to terminate a typical coaxial cable that consists of a pair of conductors situated in a concentric arrangement onto a surface of a PCB.

It is a further object of the present invention to provide a coaxial cable assembly of the type under discussion that performs simultaneous termination both of the center conductor as well as the outer metallic shield in one step or operation.

It is still another object of the present invention to provide a modular design as in the previous objects that incorporates a plastic housing that can withstand the temperatures of a reflow oven.

It is yet a further object of the present invention to provide a surface mountable coaxial cable connector assembly that can be readily modified for differently dimensioned coaxial cables with meshed wire as well as solid center conductors.

In order to achieve the above objects, a surface mount coaxial cable connector in accordance with the invention comprises a generally elongate block with spaced parallel upper and lower surfaces generally defining a longitudinal direction and proximate and remote ends. A channel, preferably stepped, extends between said proximate and remote ends intermediate said upper and lower surfaces along said elongate block to define a generally central plane of symmetry normal to said surfaces for receiving a coaxial cable formed with a central conductor, an intermediate insulating layer over the central conductor, a metallic shield covering the insulating layer and an outer layer covering and protecting the metallic shield. Said channel includes an upstream larger diameter channel portion extending from said proximate end to an intermediate point between said ends and defining a first axis arranged on said central plane for receiving an untrimmed section of coaxial cable with little clearance and a downstream, smaller diameter channel portion extending between said intermediate point and said remote end and defining a second axis arranged on said central plane dimensioned for receiving with little clearance the central conductor and intermediate dietectric insulating layer after the shield and the outer layer have been removed, said lower surface being provided with a plurality of slots extending from said lower surface to said stepped channel, at least one slot being arranged along said central plane and aligned with a central conductor of a coaxial cable received within the smaller diameter channel and least one slot being offset from said central plane to be offset or spaced from the central conductor when the coaxial cable is received within the larger diameter channel; a plurality of piercing blade contacts receivable within said slot(s) and extending beyond said lower surface that have extended piercing contact portions with opposing free edges suitable for surface mounting on a printed circuit board, insertion of a coaxial cable into the channel and application of pressure on the upper surface of said block while said piercing blade contacts are immobilized against a flat surface causes the piercing blades to move through the central or axial slot(s) piercing and making contact only with the central conductor and through the offset slot(s) piercing and making contact only with the metallic wire braided or foil shield, whereby said block can be surface mounted and soldered on a PCB when said edges are placed on and in contact with lower surface facing the PCB and pressure is applied on said upper surface to urge said block in the direction of the PCB.

BRIEF DESCRIPTION OF THE DRAWINGS

Those skilled in the art will appreciate the improvements and advantages that derive from the present invention upon reading the following detailed description, claims, and drawings, in which:

DESCRIPTION OF PREFERRED EMBODIMENT

Figure 1:
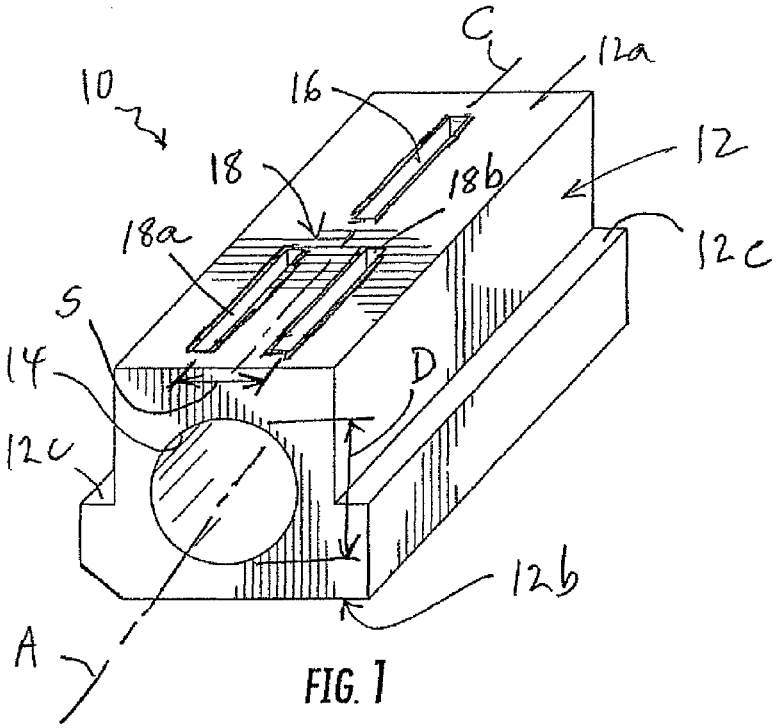
FIG. 1 is a perspective view of a surface mount coaxial cable connector in accordance with the invention.

Referring now specifically to the Figures, in which identical or similar parts are designated by the same reference numerals throughout, and first referring to FIG. 1-6, a surface mountable coaxial connector is illustrated and generally designated by he reference numeral 10. The surface mountable coaxial connector 10 shares some common features with the connector disclosed in U.S. Pat. No. 7,320,616, assigned to Zierick Manufacturing Corporation and the contents of this patent is incorporated as if fully set forth herein.

The coaxial connector 10 includes a plastic housing or block 12 that is generally elongate and defines an axis A. The housing 10 may be made of a glass filled nylon or any other material that is capable of withstanding the temperatures of a reflow oven, approximately 250-255° C. when placed on a printed circuit board 13 with solder paste. The housing or block 12 defines substantially parallel surfaces, including a lower surface 12*a* and an upper surface 12*b*. Advantageously, a point intermediate the flat surfaces 12*a*, 12*b* there are provided two laterals steps 12*c* resulting in the upper surface 12*b* being larger than the lower surface 12*a*, for reasons to be described.

Extending generally along the axis A between the surfaces 12*a*, 12*b* is a channel including a larger diameter $D_1$ channel portion 14 having and axis $A_1$ coextensive with the axis A at the inlet, upstream or proximate end "p", the front end, as viewed in FIG. 1, and a smaller diameter $D_2$ channel portion 20 in communication with the large diameter channel 14 at the opposing outlet or remote end "r". The channel portion 20 has an axis $A_2$ radially offset from the axes A, $A_1$ a distance 8 (FIG. 5) equal to $$\delta = \frac{D_1 - D_2}{2}$$

to substantially arrange both channel portions tangent to a line L (FIG. 6) substantially equidistant from the lower surface 12*a*. The two channels portions 14, 20 are not coaxial in the illustrated embodiment although S may vary with different degrees of advantage. Thus, the invention can also be practiced when channel portions 14, 20 are coextensively aligned along the axis A ($\delta \approx 4$), as it will evident to those skilled in the art.

Provided at the lower surface 12*a* is a first slot 16 that extends from the lower surface into the smaller diameter channel portion 20. At least one, but preferably two, slot 18*a*, 18*b* are provided that extend from the lower surface 12*a* to the larger diameter channel portion 14. While the slot 16 is generally aligned with the axis A and center line C the two slots 18*a*, 18*b* are offset to each side of the center line C, for reasons to be described.

The larger diameter channel portion 14 has a diameter "$D_1$" dimensioned to receive a coaxial cable 21 with little clearance. The smaller diameter channel portion 20 is dimensioned to receive the center conductor 21 and intermediate insulating dielectric layer 21*b* after the end of the coaxial cable has been trimmed to remove the outer insulating layer 21*d* as well as the metallic, normally braided or foil shield 21*c*.

Figure 2:
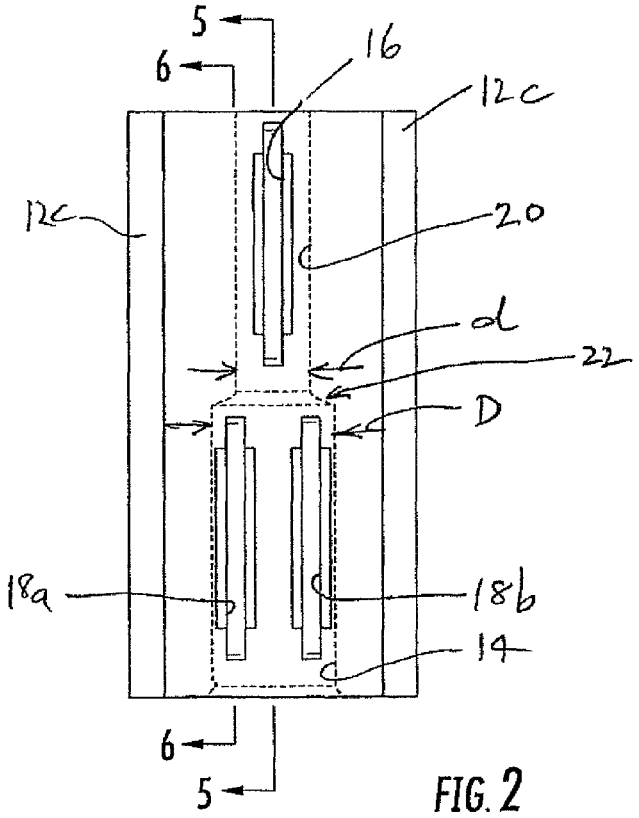
FIG. 2 is a bottom plan view of the surface mount coaxial cable connector shown in FIG. 1 with piercing blade contacts inserted therein.
Figure 3:
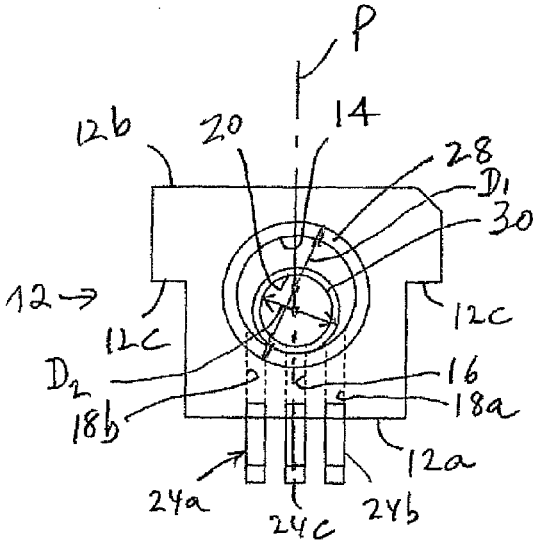
FIG. 3 is a front elevational view of the connector shown in FIG. 1, as viewed from the upstream end through which the coaxial cable is initially inserted prior to piercing of the cable.
Figure 4:
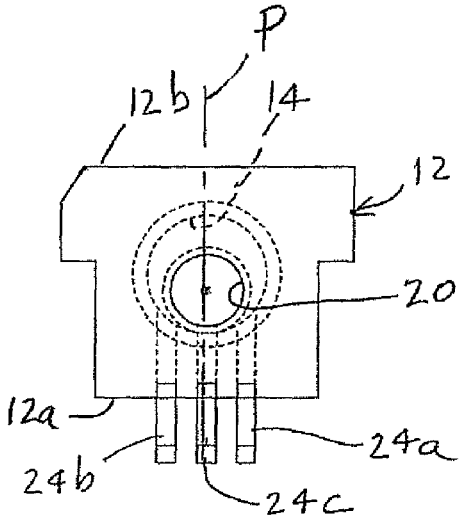
FIG. 4 is similar to FIG. 3, but is viewed from the downstream end.

A plurality of piercing blade contacts 24*a*-24*c* each having a width w are provided respectively received within one of the slots 16, 18*a*, 18*b*, as best shown in FIGS. 3 and 4. The channel portion 20 has a diameter "$D_2$" to accommodate the outer surface of the intermediate insulating layer covering the center conductor with little clearance. The transition region 22 is where the channel portions change diameters, as best as shown in FIG. 2.

Figure 5:
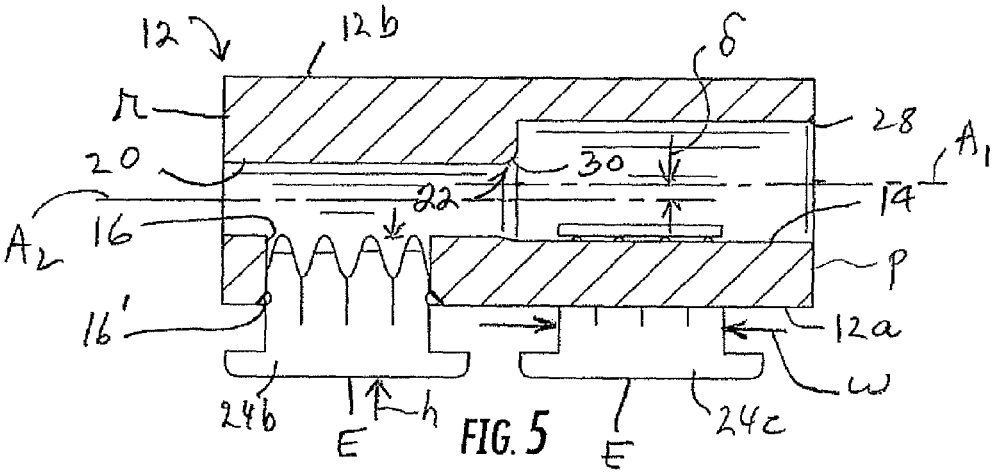
FIG. 5 is a side elevational view of the connector shown in FIGS. 1 and 2, in cross-section taken along 5-5 in FIG. 2, showing the positions of the piercing blade contacts prior to the insertion of the coaxial cable.
Figure 6:
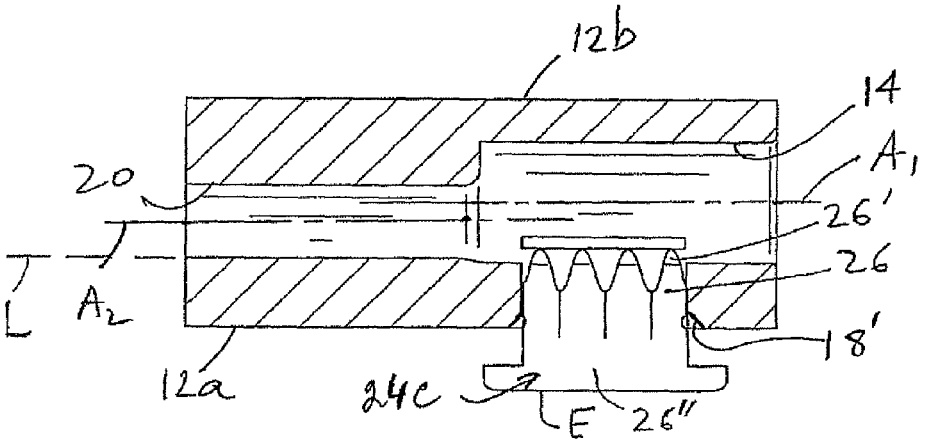
FIG. 6 is similar to FIG. 5 but taken along line 6-6 in FIG. 2.

Each of the blades 24*a*-24*c* include a series of blade fingers separated by slots as shown and formed with pointed ends 26' and all attached on a carrier 26" that extends beyond the block lower surface 12*a*. As best shown in FIG. 3, each of the circular channel portions are provided with a taper to facilitate insertion of a coaxial cable, taper 28 being provided at the larger diameter channel portion while taper 30 is provided at the transition region 22 where the channel portions change diameters (FIG. 5).

Figure 7:
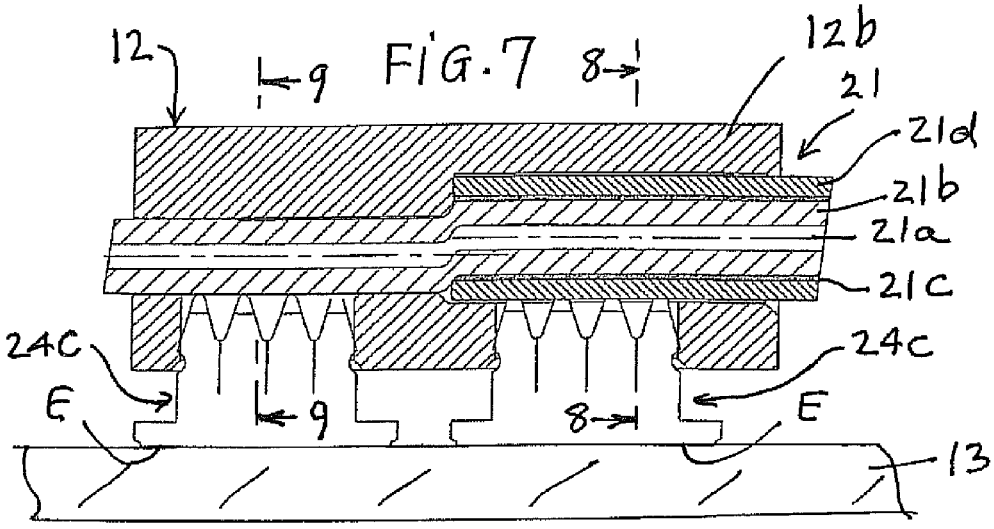
FIG. 7 is similar to FIG. 5 but showing the coax cable in place prior to penetration of the piercing blade contact through the intermediate insulating layer and center conductor.
Figure 10:
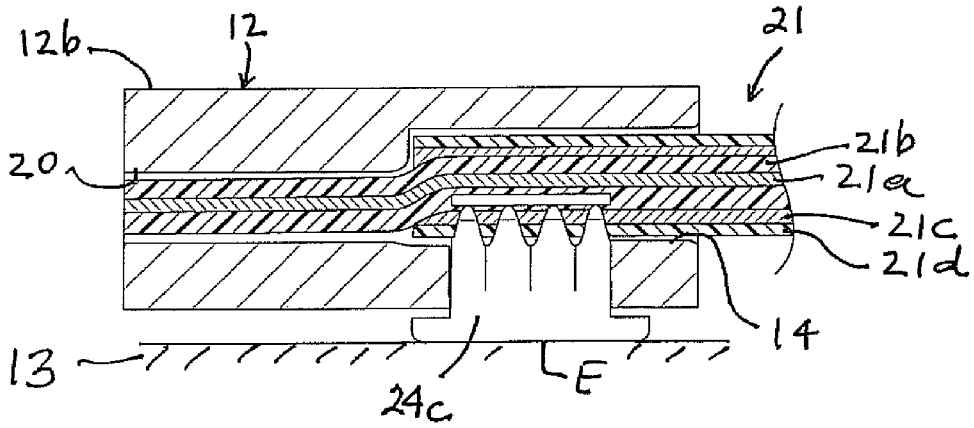
FIG. 10 is similar to FIG. 6 but shown with the piercing blade contacts penetrating the outer insulation for contact with the metallic foil or braided wire shield.
Figure 12:
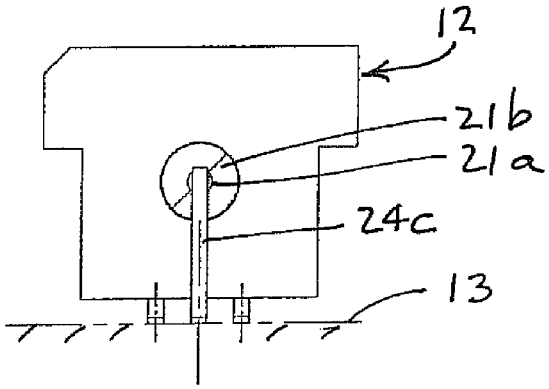
FIG. 12 is similar to FIG. 9 shown after penetration and piercing of the insulation and contact of the central piercing blade contact with the central conductor.
Figure 8:
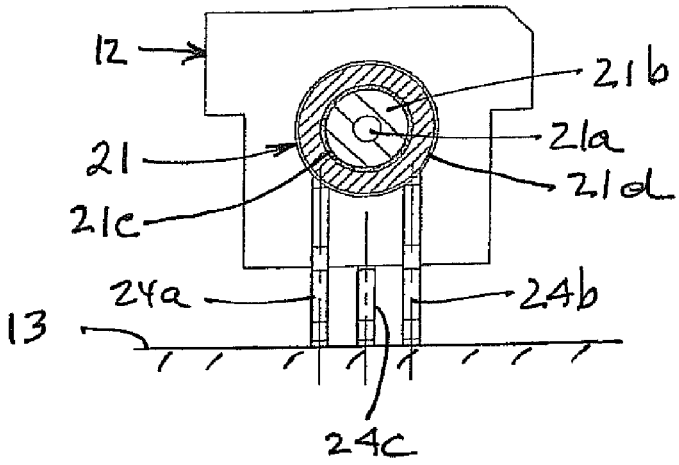
FIG. 8 is an end elevational view of the upstream end of the connector shown in FIG. 7 prior to penetration of the piercing blade contact.
Figure 11:
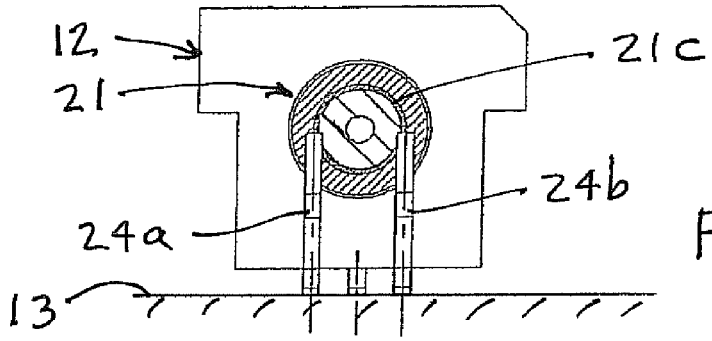
FIG. 11 is similar to FIG. 8 but showing the penetration of the outer insulation and the metallic shield following the downward movement of the connector by application of a force at the upper surface thereof.
Figure 9:
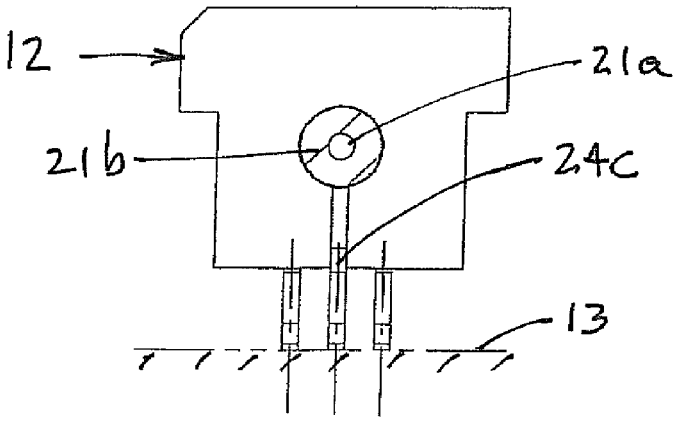
FIG. 9 is similar to FIG. 8 but shown from the downstream end of the connector.

Referring to FIGS. 7-9, the procedure for mounting and terminating the coaxial cable includes the following steps:

1. A coaxial cable connector assembly 10 is surface mounted on a printed circuit board (PCB) 13 in any conventional manner, such as by means of a pick-and-place machine followed by reflow soldering. This attaches the lower edges "E" of the piercing blades, 24*a*-24*c* on associated pads on a printed circuit board, as described in U.S. Pat. No. 7,320,616.
2. A coaxial cable 21 to be terminated is prepared by trimming or stripping away an axial length of approximately 0.25" of the outer cable insulation 21*d* and metallic shield 21*c* thereby exposing the central conductor 21*a* covered by the intermediate dielectric insulator 21*b*.
3. The cable is then inserted into the housing block 12 at the proximate end "p" by inserting the coaxial cable into the larger diameter channel portion 14 at the upstream end until the stripped away or trimmed portion is fully seated within the smaller diameter channel portion 20. This is illustrated in FIG. 7, in which the stripped away portion is also illustrated to be slightly radialy offset from the axis A in order to be received within the offset smaller diameter channel portion 20. This offset is to selected arrange the lowermost surfaces of the channel portions along line L (FIG. 6) at a common elevation or spacing from the lower surface 12*a* to position the piercing points 26' of equally dimensioned contact blades along the lower surfaces of both the trimmed and untrimmed coaxial cable portions within each of the differently diametered channel portions. An arrow or other indicia (not shown) may be provided on the housing to indicate the direction of cable insertion.
4. After the coaxial cable 21 has been inserted into the housing 12, with the piercing contact points facing upwardly as shown in FIG. 7 and the upper surface 12*b* at the top the housing block is pressed downwardly by any suitable press or other suitable machinery to cause the housing to be lowered relative to the stationary piercing blade contacts to pierce through the respective wire insulations. This is preferably achieved with a tool designed to move the housing block 12 downwardly as described a predetermined height to insure that the piercing blade points penetrate the center conductor, in the region of the smaller diameter channel portion 20, and penetrate the braided shield 21*c* in the larger diameter channel 14. However, because the piercing blade contacts extending through the slot, 18*a*, 18*b* are offset from the center line C, they do not penetrate the center conductor 21*a* even if they penetrate the braided shield 21*c* and the intermediate insulating layer 21*b*, as suggested in FIG. 10.

The two channel portions 14, 20 are offset to be able to use the same length piercing blade contacts while achieving the desired penetration and contact with the associated conductors. However, clearly, if desired, the invention can also be practiced by aligning the smaller and larger diameter channels so they are axially coextensive. However, in that case, the piercing blade contacts inserted through the center slot 16 may need to be somewhat longer to reach the center conductor 21*a* of the coaxial cable when all the piercing blade contacts are moved the same incremental distances relative to the downward movement of the housing 12 by a common press.

For an RG 174 coaxial cable the diameter "$D_1$" is approximately 0.110" while the diameter "$D_2$" of the smaller channel is approximately 0.062". Advantageously, the center slot 16 is provided with a taper 16' and similar tapers 18' are provided for each of the offset slots 18*a*, 18*b* to facilitate insertion of the piercing blade contacts 24*a*-24*c*.

The surface area 12*b* is somewhat larger than the surface 12*a* to allow a greater force to be applied over the larger area to insure suitable penetration of the piercing blade contact points into the respective insulations and conductors.

It is intended that the invention will be used with both solid center conductors as well as braided wire central conductors and, as suggested, the dimensions "$D_1$" and "$D_2$" can be suitably selected to accommodate different sizes of coaxial cables.

The invention terminates a typical coaxial cable easily, quickly and in more automated fashion to a printed circuit board using surface mounting techniques.

While three piercing terminals have been shown, it is clear that different numbers of piercing terminals and associated slots can be used to provide for different PCB surface geometries, as long as at least one piercing blade contacts the center conductor and at least one blade contacts the metallic wire braiding or foil.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

The invention claimed is:

1. A surface mount coaxial cable connector comprising a generally elongate block with spaced parallel upper and lower surfaces generally defining a longitudinal direction and proximate and remote ends; a stepped channel extending between said proximate and remote ends intermediate said upper and lower surfaces along said elongate block to define a generally central plane of symmetry normal to said surfaces for receiving a coaxial cable formed with a central conductor, an intermediate insulating layer over the central conductor, a metallic shield covering the insulating layer and an outer layer covering and protecting the metallic shield, said channel including an upstream larger diameter channel portion extending from said proximate end to an intermediate point between said ends and defining a first axis arranged on said central plane for receiving an untrimmed section of coaxial cable with little clearance and a downstream, smaller diameter channel portion extending between said intermediate point and said remote end and defining a second axis arranged on said central plane dimensioned for receiving with little clearance the central conductor and intermediate dielectric insulating layer after the shield and the outer layer have been removed, said lower surface being provided with a plurality of slots extending from said lower surface to said stepped channel, at least one slot being arranged along said central plane and aligned with a central conductor of a coaxial cable received within the smaller diameter channel and least one slot being offset from said central plane to be offset or spaced from the central conductor when the coaxial cable is received within the larger diameter channel; a plurality of piercing blade contacts receivable within said slot(s) and extending beyond said lower surface that have extended piercing contact portions with opposing free flat edges suitable for surface mounting on a printed circuit board, insertion of a coaxial cable into the stepped channel and application of pressure on the upper surface of said block while said piercing blade contacts are immobilized against a flat surface causes the piercing blades to move through the central or axial slot(s) piercing and making contact only with the central conductor and through the offset slot(s) piercing and making contact only with the metallic wire braided or foil shield, whereby said block can be surface mounted and soldered on a PCB when said flat edges are placed on and in contact with lower surface facing the PCB and pressure is applied on said upper surface to urge said block in the direction of the PCB, wherein said larger diameter upstream channel portion has a diameter $D_1$ and said smaller diameter downstream channel portion has a diameter $D_2$ and the radial offset δ between said diameters is equal to $$\delta = \frac{D_1 - D_2}{2}.$$

2. The surface mount coaxial cable as defined in claim 1, wherein said piercing blade contacts have a height h along a direction of movement during piercing of said contacts from said free edges to opposing piercing tips.

3. The surface mount coaxial cable as defined in claim 2, wherein all said piercing blade contacts have a height h irrespective of whether they are inserted into said upstream channel portion for piercing an untrimmed section of coaxial cable or inserted into said downstream channel portion for piercing a central conductor and intermediate dielectric insulating layer of a trimmed end of a coaxial cable.

4. The surface mount coaxial cable as defined in claim 1, wherein said axial lengths of said upstream and downstream channels are substantially equal.

5. The surface mount coaxial cable as defined in claim 1, wherein said piercing blade contacts have a width w along said longitudinal direction of said elongate block and each of said channels has an axial length substantially equal to w.

6. The surface mount coaxial cable as defined in claim 1, wherein a plurality of slots are provided offset from said central plane for movement of associated piercing blade contacts into said larger diameter channel.

7. The surface mount coaxial cable as defined in claim 6, wherein two slots are provided for movement of associated piercing blade contacts into said larger diameter channel.

8. The surface mount coaxial cable as defined in claim 1, wherein said axial lengths of said upstream and downstream channel portions are substantially equal.

9. The surface mount coaxial cable as defined in claim 1, wherein said piercing blade contacts have a width w along said longitudinal direction of said elongate block and each of said channels have an axial length greater than w.

10. A surface mount coaxial cable connector comprising a generally elongate block with spaced parallel upper and lower surfaces generally defining a longitudinal direction and proximate and remote ends; a channel extending between said proximate and remote ends intermediate said upper and lower surfaces along said elongate block to define a generally central plane of symmetry normal to said surfaces for receiving a coaxial cable formed with a central conductor, an intermediate insulating layer over the central conductor, a metallic shield covering the insulating layer and an outer layer covering and protecting the metallic shield, said channel including an upstream larger diameter channel portion extending from said proximate end to an intermediate point between said ends and defining a first axis arranged on said central plane for receiving an untrimmed section of coaxial cable with little clearance and a downstream, smaller diameter channel portion extending between said intermediate point and said remote end and defining a second axis arranged on said central plane dimensioned for receiving with little clearance the central conductor and intermediate dielectric insulating layer after the shield and the outer layer have been removed, said lower surface being provided with a plurality of slots extending from said lower surface to said stepped channel, at least one slot being arranged along said central plane and aligned with a central conductor of a coaxial cable received within the smaller diameter channel and at least one slot being offset from said central plane to be offset or spaced from the central conductor when the coaxial cable is received within the larger diameter channel; a plurality of piercing blade contacts receivable within said slot(s) and extending beyond said lower surface that have extended piercing contact portions with opposing free flat edges suitable for surface mounting on a printed circuit board, insertion of a coaxial cable into the stepped channel and application of pressure on the upper surface of said block while said piercing blade contacts are immobilized against a flat surface causes the piercing blades to move through the central or axial slot(s) piercing and making contact only with the central conductor and through the offset slot(s) piercing and making contact only with the metallic wire braided or foil shield, whereby said block can be surface mounted and soldered on a PCB when said flat edges are placed on and in contact with lower surface facing the PCB and pressure is applied on said upper surface to urge said block in the direction of the PCB, wherein said larger diameter upstream channel has a diameter $D_1$ and said smaller diameter downstream channel has a diameter $D_2$ and the radial offset δ between said diameters is equal to $$\delta = \frac{D_1 - D_2}{2}.$$

11. The surface mount coaxial cable as defined in claim 10, wherein said piercing blade contacts have a height h along a direction of movement during piercing of said contacts from said free edges to opposing piercing tips.

12. The surface mount coaxial cable as defined in claim 11, wherein all said piercing blade contacts have a height h irrespective of whether they are inserted into said upstream channel portion for piercing an untrimmed section of coaxial cable or inserted into said downstream channel portion for piercing a central conductor and intermediate dielectric insulating layer of a trimmed end of a coaxial cable.

13. The surface mount coaxial cable as defined in claim 10, wherein a plurality of slots are provided offset from said central plane for movement of associated piercing blade contacts into said larger diameter channel.

14. A surface mount coaxial cable as defined in claim 13, wherein two slots are provided for movement of associated piercing blade contacts into said larger diameter channel.

15. A method of terminating a coaxial cable in a surface mount connector comprising a generally elongate block with spaced parallel upper and lower surfaces generally defining a longitudinal direction and proximate and remote ends; a stepped channel extending between said proximate and remote ends intermediate said upper and lower surfaces along said elongate block to define a generally central plane of symmetry normal to said surfaces for receiving a coaxial cable formed with a central conductor, an intermediate insulating layer over the central conductor, a metallic shield covering the insulating layer and an outer layer covering and protecting the metallic shield, said channel including an upstream larger diameter channel portion extending from said proximate end to an intermediate point between said ends and defining a first axis arranged on said central plane for receiving an untrimmed section of coaxial cable with little clearance and a downstream, smaller diameter channel portion extending between said intermediate point and said remote end and defining a second axis arranged on said central plane dimensioned for receiving with little clearance the central conductor and intermediate dielectric insulating layer after the shield and the outer layer have been removed, wherein said larger diameter upstream channel portion has a diameter $D_1$ and said smaller diameter downstream channel portion has a diameter $D_2$ and the radial offset δ between said diameters is equal to $$\delta = \frac{D_1 - D_2}{2}$$

said lower surface being provided with a plurality of slots extending from said lower surface to said stepped channel, at least one slot being arranged along said central plane and aligned with a central conductor of a coaxial cable received within the smaller diameter channel portion and least one slot being offset from said central plane to be offset or spaced from the central conductor when the coaxial cable is received within the larger diameter channel portion; a plurality of equally dimensioned piercing blade contacts receivable within said slot(s) and extending beyond said lower surface that have extended piercing contact portions with opposing free flat edges suitable for surface mounting on a printed circuit board, insertion of a coaxial cable into the stepped channel and application of pressure on the upper surface of said block while said piercing blade contacts are immobilized against a flat surface causes the piercing blades to move through the central or axial slot(s) piercing and making contact only with the central conductor and through the offset slot(s) piercing and making contact only with the metallic wire braided or foil shield, whereby said block can be surface mounted on a PCB when said flat edges are placed on and in contact with lower surface facing the PCB, the method comprising the steps of trimming a free end of a coaxial cable to remove the metallic shield and outer protective layer over a first predetermined axial length of the cable;

inserting the free end of the cable into said offset channel within said block to position said trimmed end to within said smaller diameter channel portion and contiguous untrimmed portion of the cable with said larger diameter channel portion;

with said free flat edges of said piercing contacts blades on a generally stationary flat surface applying a force on said upper surface of said block in the direction of said stationary flat surface to urge said piercing contact blades within said slots to move inwardly into said block and pierce respective portions of said cable within said smaller and larger diameter channel portions.

16. The method as defined in claim 15, wherein said stationary flat surface is a PCB.

17. The method as defined in claim 15, wherein said free flat edges are soldered to a PCB prior to application of force to said upper surface.

* * * * *